United States Patent [19]

Brauer

[11] 4,352,322

[45] Oct. 5, 1982

[54] PREFABRICATED VEHICLE MAINTENANCE APPARATUS

[76] Inventor: Roger L. Brauer, 602 W. Austin St., Tolono, Ill. 61880

[21] Appl. No.: 255,184

[22] Filed: Apr. 17, 1981

[51] Int. Cl.[3] ..... F24F 13/00

[52] U.S. Cl. ..... 98/33 R; 52/174; 137/234.6; 137/363; 141/98; 182/128; 184/1.5

[58] Field of Search ..... 137/234.6, 342, 357, 137/363; 184/1.5; 141/98; 52/169.5, 169.7, 174; 98/33 R, 39; 182/128, 223

[56] References Cited

U.S. PATENT DOCUMENTS

| | | | |
|---|---|---|---|
| 1,327,120 | 1/1920 | Stewart | 98/33 R |
| 1,654,073 | 12/1927 | Fagan | 184/1.5 |
| 2,346,033 | 4/1944 | Jordan | 182/128 |
| 3,084,517 | 4/1963 | Bell | 52/174 X |
| 3,517,771 | 6/1970 | Mähbinger | 182/128 X |
| 4,122,761 | 10/1978 | Westin | 98/33 R |
| 4,284,173 | 8/1981 | Patterson | 137/234.6 X |

*Primary Examiner*—Harold W. Weakley
*Attorney, Agent, or Firm*—Darrell E. Hollis

[57] ABSTRACT

A prefabricated vehicle maintenance apparatus is disclosed, including a housing having bottom, side and end walls, which housing is adapted for insertion within a pit formed in the ground. A horizontal platform is arranged in the housing for supporting a mechanic beneath a vehicle arranged in straddling relation above the pit, the platform normally having effective width and length dimensions corresponding generally with the spacing distances between the housing side and end walls, respectively. The vehicle maintenance apparatus further includes a platform lifting device for vertically displacing the horizontal platform between upper and lower levels relative to the housing bottom wall, at least one of the effective width and length dimensions of the horizontal platform being variable to define an opening affording access to the portion of the housing bottom wall arranged beneath the platform.

9 Claims, 4 Drawing Figures

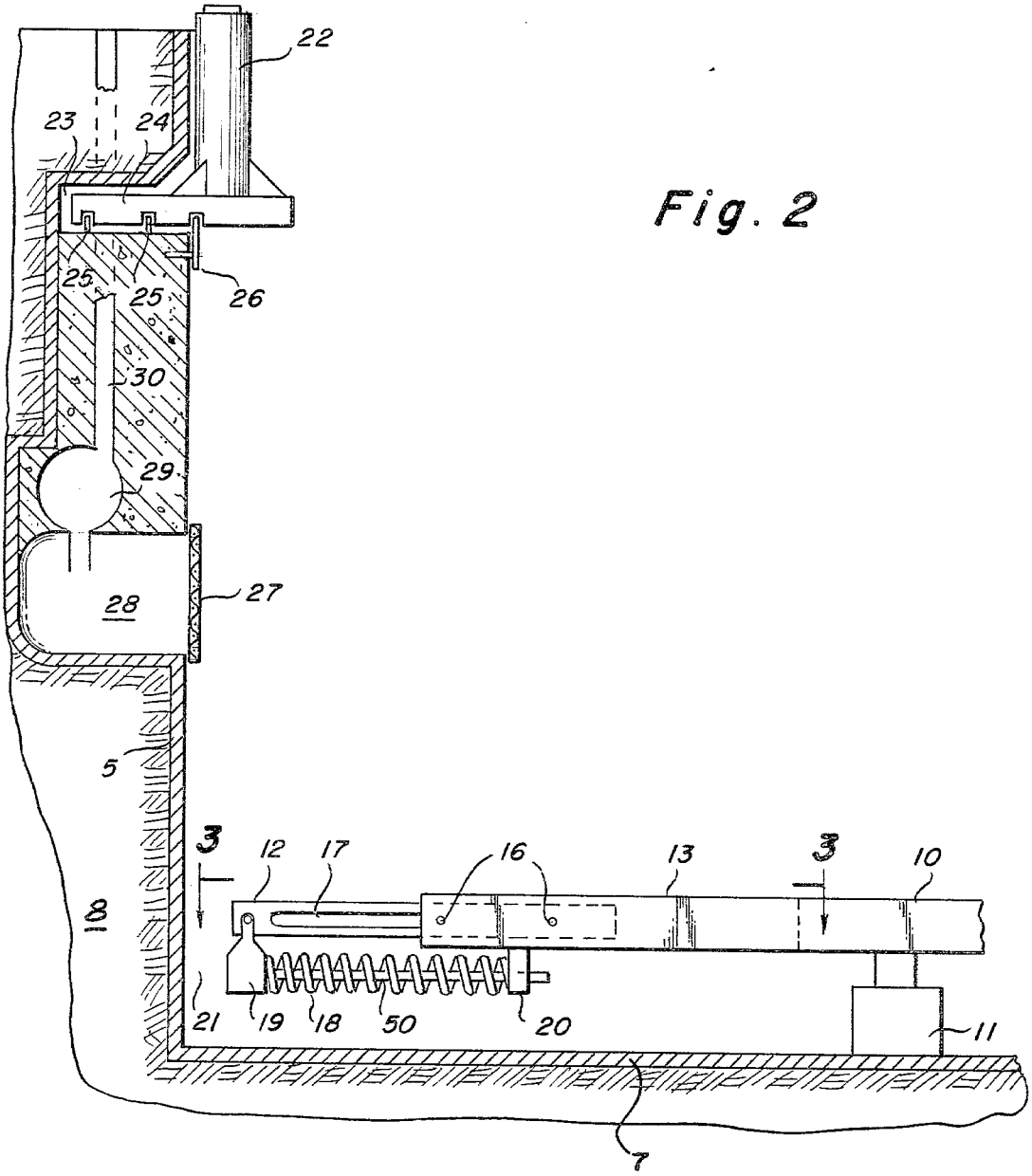
Fig. 2
Fig. 3
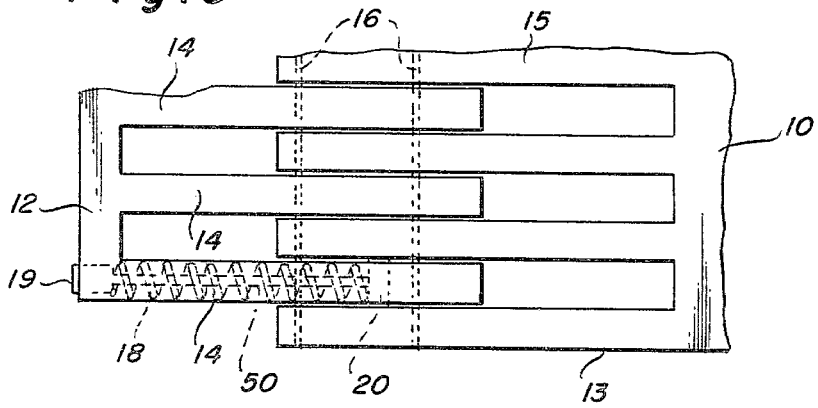

PREFABRICATED VEHICLE MAINTENANCE APPARATUS

STATEMENT OF GOVERNMENT INTEREST

The invention described and claimed herein may be manufactured and used by or for the Government of the United States of America for governmental purposes without the payment of royalties thereon or therefor.

BACKGROUND OF THE INVENTION

The present invention relates to prefabricated vehicle maintenance apparatus adapted for insertion within a pit. The various vehicle maintenance devices of the prior art do not provide complete accessibility to a vehicle located over the housing for mechanics of varying heights and reaches. Furthermore, the housing apparatus of the prior art fail to provide mechanics with all the equipment necessary to perform complete servicing of a vehicle from the housing. Furthermore, poor ventiliation means exist in these housings, thereby creating an unsafe working atmosphere. Alternatives to maintenance housing apparatus adapted for pits are lifts, jacks and creepers. However, lifts are inconvenient for larger vehicles as they block areas to be serviced, jacks have a limited range of lift, thereby limiting the accessibility to the vehicle, and creepers are difficult and inconvenient to work from while performing service operations.

SUMMARY OF THE INVENTION

Accordingly, an object of the present invention is to provide a prefabricated vehicle maintenance apparatus which overcomes the above disadvantages and which provides a convenient, functional and safe means for servicing a vehicle.

It is a further object of the present invention to provide a prefabricated vehicle maintenance apparatus adapted for insertion within a pit formed in the ground for servicing a vehicle positioned thereover, said apparatus comprising a housing, and horizontal platform means arranged in the housing for supporting a mechanic, which platform means may be vertically displaced between upper and lower levels relative to the bottom wall of the housing.

It is a further object of the present invention to provide a prefabricated vehicle maintenance apparatus comprising horizontal platform means having means for varying at least one of the effective width and length dimensions to define an access opening to the portion of the housing bottom wall arranged beneath the platform means.

It is another object to provide a prefabricated vehicle maintenance apparatus having a ventilation system which adequately removes vehicle exhaust and other hazardous or odorous gases and particulates from the apparatus, thereby effecting a safe and healthy working atmosphere.

It is another object to provide a prefabricated vehicle maintenance apparatus comprising all the equipment necessary to allow a mechanic to service a vehicle positioned over the apparatus completely and efficiently from within the housing.

BRIEF DESCRIPTION OF THE DRAWINGS

Other objects and advantages of the present invention will be understood from a further and detailed description of the drawings, in which:

FIG. 2 is one embodiment of a cross-sectional side view of one end of the prefabricated vehicle maintenance apparatus taken along line 2—2 of FIG. 1;

FIG. 3 is one embodiment of a top view of one end of the horizontal platform means taken along line 3—3 of FIG. 2.

DETAILED DESCRIPTION

Figure 1:
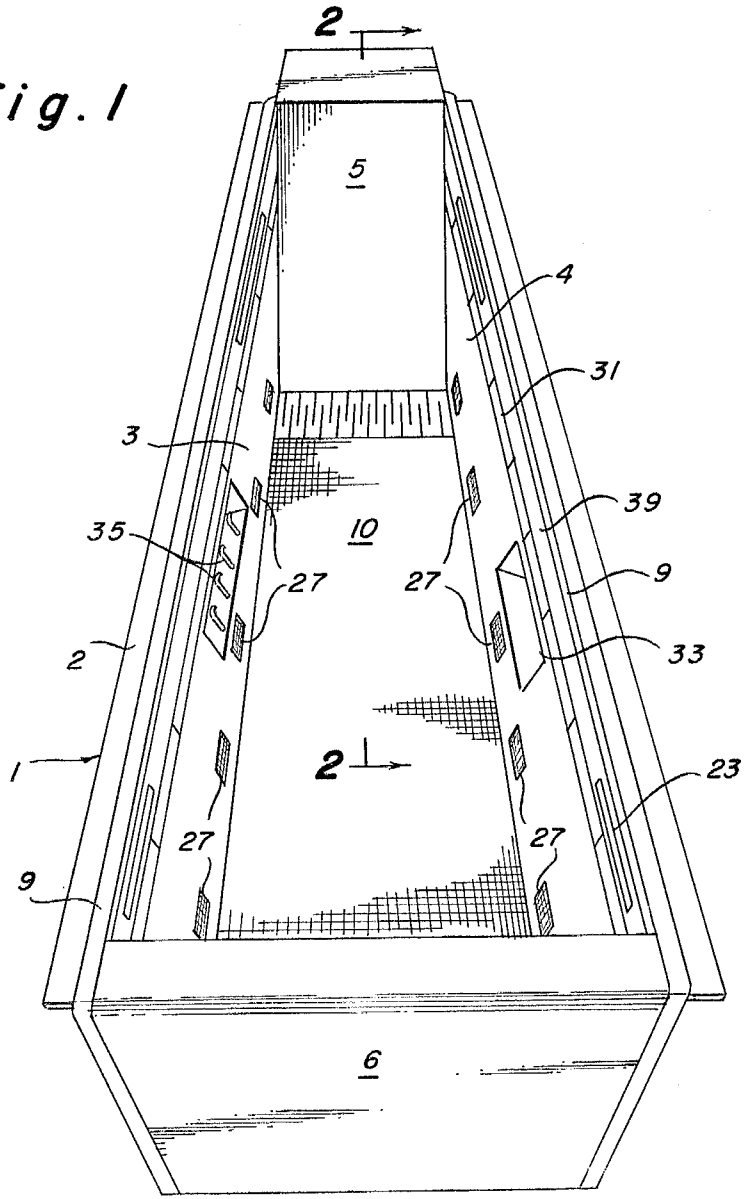
FIG. 1 is a front perspective view of the prefabricated vehicle maintenance apparatus.

Referring to FIGS. 1 and 2, there is shown a prefabricated vehicle maintenance apparatus 1, comprising a housing 2 having opposed pairs of parallel spaced, vertical side walls 3 and 4, and end walls 5 and 6, respectively, secured at their lower edges with bottom wall 7. Housing 2 is adapted for insertion within a pit formed in the ground 8 and facilitates the servicing of a vehicle arranged over the pit.

Side walls 3 and 4 are spaced a distance less than the spacing distance between corresponding wheels of a vehicle, whereby the vehicle can be positioned in straddling relation above the housing. The upper edges of side walls 3 and 4 are provided with wheel curbs 9 in the form of vertically extending flanges which act as guides or guards for the tires of a vehicle arranged over the housing. The curbs 9 thereby prevent the vehicle from falling into the housing interior and correctly guide the vehicle into position over the housing for servicing.

The prefabricated vehicle maintenance apparatus 1 further comprises a novel horizontal platform means 10 arranged in housing 2 for supporting a mechanic, which platform means may be vertically displaced between upper and lower levels relative to the housing bottom wall 7. The vertically displaceable horizontal platform means 10 allows all points on the underside of a vehicle to be reached during servicing by mechanics of varying heights and reaches.

FIGS. 2 and 3 provide detailed views of platform means 10. Platform lifting means comprises support members 11 connecting platform means 10 with the housing bottom wall 7, which support members 11 are vertically extendable, thereby displacing horizontal platform means 10 between upper and lower levels relative to the housing bottom wall. Power for extending support members 11 may be provided by any suitable manual or power means such as air, hydraulic, electrical or mechanical devices. Controls for the lifting means are provided at any convenient location in the housing, thereby leaving a mechanic free to perform other activities in the housing.

Platform means 10 is of a suitable material which has a slip resistant surface and preferably is perforated to allow spilled materials to pass through to housing bottom wall 7 to be collected or drained. The platform means normally has effective width and length dimensions corresponding generally with the spacing distance between the housing side and end walls, respectively. There is provided in housing 2, however, means for varying at least one of the effective width and length dimensions of platform means 10 to provide an access opening to the portion of housing bottom wall 7 arranged beneath said platform means.

Platform means 10 includes at least two sections normally arranged in coplanar longitudinal relation relative to each other and means connecting a first one of the sections for movement from a first position to a second position relative to the other section, thereby to reduce the effective length of the platform means, whereby an access opening is defined adjacent one of the housing end walls.

Referring to the longitudinally extensible and contractable platform embodiment of FIGS. 2 and 3, the platform means 10 includes two sections 12 and 13 arranged in coplanar, longitudinal relation relative to each other, which sections 12 and 13 each have a plurality of longitudinally extending flanges 14 and 15, respectively. Means connecting first section 12 for movement relative to second section 13 include retaining bars 16 rigidly secured between spaced flanges 15 of the second section 13. The first section 12 is slidably mounted on retaining bars 16 by means of slots 17 which are included in flanges 14. First section 12 slides along retaining bars 16 in telescopic relation relative to second section 13, interleaving the flanges 14 with the flanges 15, and thereby reducing the effective length of platform means 10, whereby an access opening 21 is defined adjacent end wall 5, permitting a person to descend beneath the platform.

First section 12 is biased towards an extended position relative to second section 13 by compression spring means 18 which is mounted concentrically about guide rod 50, one end of the rod being connected with section 12 via connector 19, and the other end being slidably mounted in bearing 20 connected with section 13.

The sections of the platform means may be movably connected in a manner different from that already described without departing from the present invention. In a second embodiment, the first platform section is hingedly connected with one end of the second for pivotal displacement between open and closed positions relative to the access opening.

The prefabricated vehicle maintenance apparatus of the present invention includes additional features which form a complete, convenient and functional service apparatus.

Jack means 22 are provided for elevating a portion of a vehicle during servicing which jack means are adapted for easy insertion within a slot 23 contained in a housing side or end wall. Jack means 22 comprises a horizontal flange 24 which fits within slot 23, and guides or rollers 25 which allow the jack means to move freely along the slot. Rollers 25 are of sufficient strength to carry the load of the jack or they will collapse under loading so that the jack bears directly on the bottom wall of slot 23. There is a vertical flange 26 provided on the housing wall at the bottom edge of slot 23, which flange prevents the jack means 22 from falling out of slot 23. Jack means 22 can be actuated by any power source such as air, hydraulic or mechanical devices with controls conveniently located in the housing.

A ventilation system is included in the prefabricated vehicle maintenance apparatus for removing exhaust and other hazardous, odorous gases and particulates from the working atmosphere. A plurality of grills 27 are provided in the housing side and end walls, which grills direct gases from the interior of the housing to the main duct 28 of the ventilation system. A motor driven exhaust blower 29 is located adjacent the main duct area 28 and conducts gases to conduit system 30 which delivers gases to the atmosphere.

Figure 4:
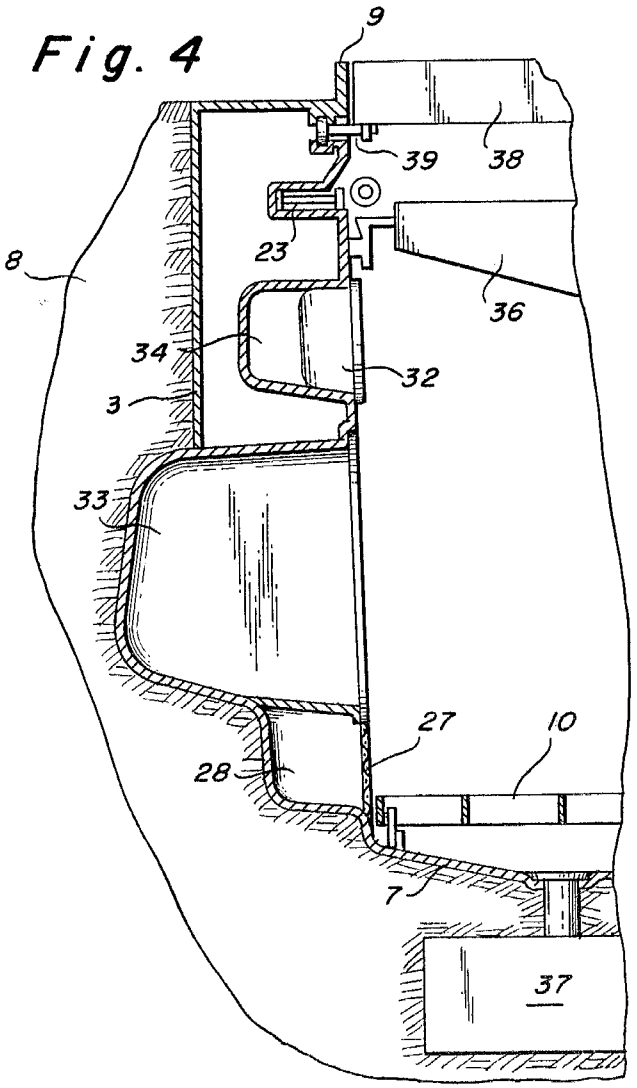
FIG. 4 is one embodiment of a cross-sectional view of a side wall of the prefabricated vehicle maintenance apparatus.

Light fixtures are included in the housing, stationary lights 31 are located in the housing side and end walls and extensible light fixtures 32 are stored in tool storage compartment 33 or 34 in the housing side walls, as shown in FIG. 4. Extensible lights 32 may be connected to a power outlet with retractable cords which allow a mechanic to position a light in any desired direction.

Fluid dispension and collection means 35 are provided in the housing side or end walls to further assist a mechanic in complete and convenient servicing of a vehicle. Dispension means include supply containers, hose and reel units and application nozzles. Collection means include hoses and pumps. Collection pans are located throughout the housing as needed, for example, along the housing walls as in pan 36 or under the platform means as is pan 37.

Retractable cover means 38 is included with the prefabricated vehicle maintenance apparatus for covering the top portion of the housing to provide a surface continuous with the ground in which the housing is inserted. Cover means 38 is similar to those of the prior art which are of a flexible material and roll onto a take up shaft located at one end wall of the housing. When in location over the housing, the cover means 38 rests on a horizontal flange or cover track 39.

The housing includes steps or a ladder at one end to provide easy entrance to and exit from the interior of the housing.

While the apparatus has been shown and described in the preferred embodiments, it will be understood that variations in specific construction and arrangements may be made without departing from the invention described above.

What is claimed is:

1. Vehicle service apparatus, comprising (a) a unitary housing including a bottom wall, and opposed pairs of parallel spaced vertical side and end walls, respectively, secured at their lower edges with said bottom wall, said housing being adapted for insertion within a pit formed in the ground, said side walls being spaced a distance less than the spacing distance between corresponding wheels of the vehicle, whereby the vehicle can be positioned in straddling relation above the housing;

(b) horizontal platform means arranged in said housing for supporting a mechanic beneath the vehicle, said platform means normally having effective width and length dimensions corresponding generally with the spacing distances between said housing side and end walls, respectively;

(c) platform lifting means for vertically displacing said platform means between upper and lower levels relative to said housing bottom wall; and (d) means for varying at least one of the effective width and length dimensions of said platform means to define an opening for providing access to the portion of the housing bottom wall arranged beneath said platform means.

2. Apparatus as defined in claim 1, wherein said platform means includes at least two sections normally arranged in coplanar, longitudinal relation relative to each other, and means connecting a first one of said sections for movement from a first position to a second position relative to the other section, thereby to reduce the effective length of said platform means, whereby said access opening is defined adjacent one of said housing end walls.

3. Apparatus as defined in claim 2, wherein said platform sections are telescopically connected for coplanar, longitudinal adjustment between extended and collapsed conditions relative to each other, and further including spring means biasing said sections toward their extended condition.

4. Apparatus as defined in claim 1, wherein said platform lifting means comprises supporting members connecting said horizontal platform with said housing bottom wall, said supporting members being vertically extendable for vertically displacing said horizontal platform means between upper and lower levels relative to said housing bottom wall.

5. Apparatus as defined in claim 1, further comprising jack means connected with one of said housing side or end walls by means of a flange on said jack means, which flange is insertable in a horizontal slot included in said housing side or end wall, whereby said jack means may be operated to elevate a portion of the vehicle during the servicing thereof.

6. Apparatus as defined in claim 1, further comprising a ventilation system for removing exhaust gases from the housing wherein said ventilation system comprises:

(a) a motor driven exhaust fan located in said housing side walls;

(b) a plurality of exhaust grill panels located in said housing side walls, which grill panels direct gases from the interior of said housing to said exhaust fan; and (c) a conduit system for directing gases from said exhaust fan to the atmosphere.

7. Apparatus as defined in claim 1, wherein at least one of said housing side and end walls further includes extensible light fixtures.

8. Apparatus as defined in claim 1, wherein at least one of said housing side and end walls further includes fluid dispensing and collection means.

9. Apparatus as defined in claim 1, wherein said housing further includes a retractable cover means for covering the top portion of the housing to provide a surface continuous with the ground in which the housing is inserted.

* * * * *